US005245833A

United States Patent [19]

Mei et al.

[11] Patent Number: 5,245,833

[45] Date of Patent: Sep. 21, 1993

[54] LIQUID OVER-FEEDING AIR CONDITIONING SYSTEM AND METHOD

[75] Inventors: Viung C. Mei, Oak Ridge; Fang C. Chen, Knoxville, both of Tenn.

[73] Assignee: Martin Marietta Energy Systems, Inc., Oak Ridge, Tenn.

[21] Appl. No.: 885,337

[22] Filed: May 19, 1992

[51] Int. Cl.[5] ..... F25B 41/00

[52] U.S. Cl. ..... 62/113; 62/503; 62/513

[58] Field of Search ..... 62/113, 503, 513

[56] References Cited

U.S. PATENT DOCUMENTS

| | | | |
|---|---|---|---|
| 3,621,673 | 11/1971 | Foust | 62/503 |
| 3,872,687 | 3/1975 | Bottum et al. | 62/503 |
| 3,955,375 | 5/1976 | Schumacher | 62/503 |
| 4,216,660 | 8/1980 | Rodgers | 62/503 |
| 4,217,765 | 8/1980 | Ecker | 62/503 |
| 4,488,413 | 12/1984 | Bottum | 62/503 |
| 4,646,527 | 3/1987 | Taylor | 62/503 |

*Primary Examiner*—Ronald C. Capossela

*Attorney, Agent, or Firm*—E. L. Larcher; J. A. Marasco; H. W. Adams

[57] ABSTRACT

A refrigeration air conditioning system utilizing a liquid over-feeding operation is described. A liquid refrigerant accumulator-heat exchanger is placed in the system to provide a heat exchange relationship between hot liquid refrigerant discharged from condenser and a relatively cool mixture of liquid and vaporous refrigerant discharged from the evaporator. This heat exchange relationship substantially sub-cools the hot liquid refrigerant which undergoes little or no evaporation across the expansion device and provides a liquid over-feeding operation through the evaporator for effectively using 100 percent of evaporator for cooling purposes and for providing the aforementioned mixture of liquid and vaporous refrigerant.

13 Claims, 1 Drawing Sheet

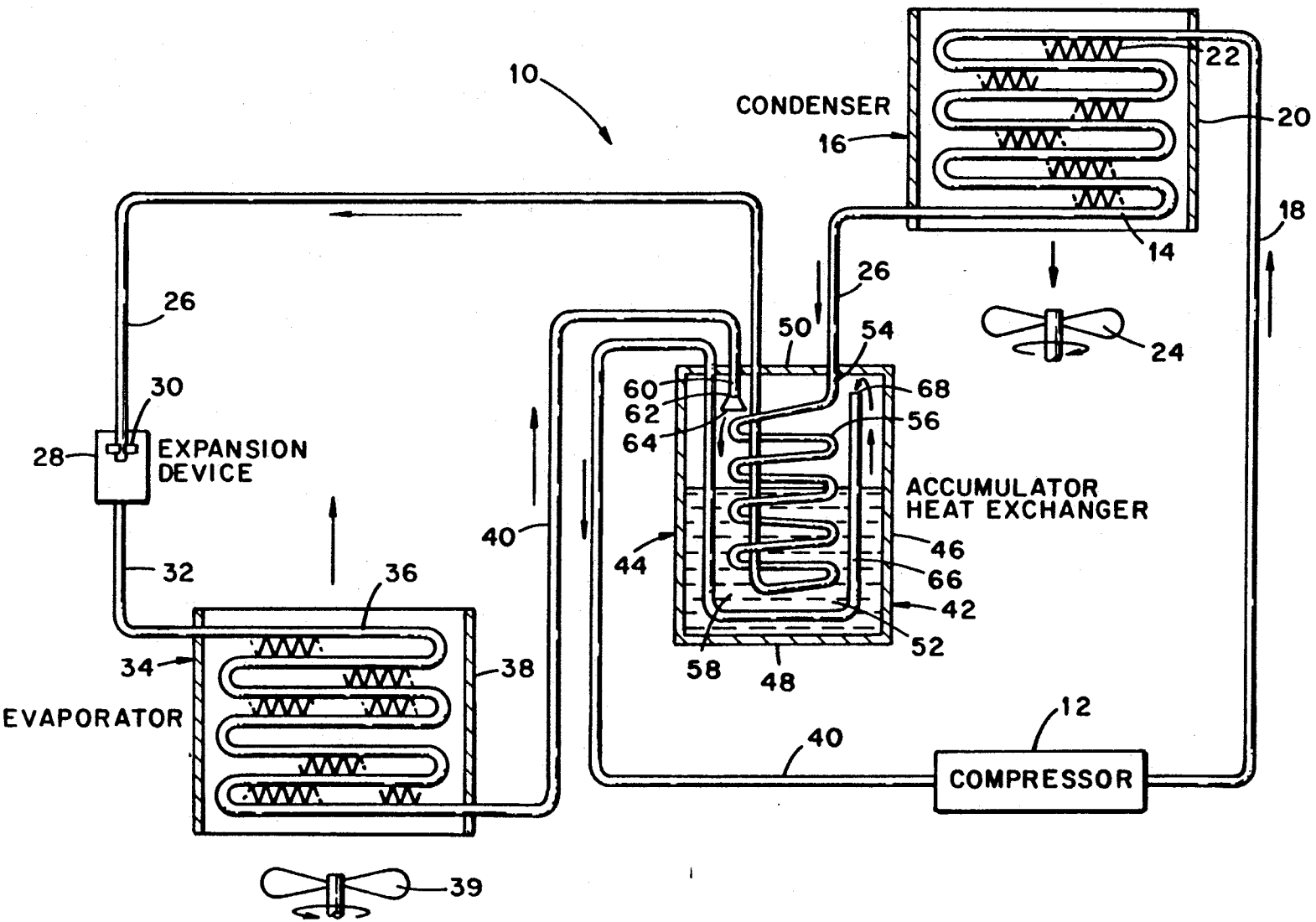
CONDENSER
ACCUMULATOR HEAT EXCHANGER
COMPRESSOR
EXPANSION DEVICE
EVAPORATOR
10
12
14
16
18
20
22
24
26
28
30
32
34
36
38
39
40
42
44
46
48
50
52
54
56
58
60
62
64
66
68

LIQUID OVER-FEEDING AIR CONDITIONING SYSTEM AND METHOD

This invention was made with the support of the United States Government under contract No. DE-AC05-840R21400 awarded by the U.S. Department of Energy. The United States Government has certain rights in this invention.

BACKGROUND OF THE INVENTION

The present relates generally to refrigeration air conditioning systems, and more particularly to an air conditioning system wherein liquid refrigerant accumulator-heat exchange means utilize a relatively cool mixture of liquid and vaporous refrigerant from the evaporator in a heat exchange relationship with hot liquid refrigerant discharged from the condenser for significantly subcooling this hot liquid refrigerant prior to the partial evaporation thereof in the evaporator for providing the aforementioned mixture and a air conditioning system with a liquid over-feeding operation.

Refrigeration air conditioning systems each include basic components defined by a compressor, condenser, expansion device, and an evaporator that are serially interconnected by a conduit or piping arrangement used for the circulation of refrigerant in liquid and vaporous form through the system. In operation of such systems, relatively cool refrigerant in gaseous or vapor form is compressed to an elevated pressure and temperature in the compressor with the temperature of the vaporous refrigerant increasing with increasing pressure due to work by the compressor. The resulting relatively hot compressed vaporous refrigerant is then condensed to liquid in the condenser with the heat given off by the condensing vapor being removed from the condenser by employing a heat exchange medium such as a moving stream of air or water. The condensed liquid refrigerant is then passed through an expansion device where the pressure of the liquid is substantially decreased. This expansion of the liquid refrigerant also results in some vaporization of the liquid refrigerant which cools the liquid refrigerant due to latent heat of vaporization. In the evaporator, the liquid refrigerant is converted to saturated vapor by absorbing heat from a heat exchange medium such as a moving stream of air or water passing through the evaporator. The saturated refrigerant vapor discharged from the evaporator is at essentially the same or at a lower pressure than the liquid refrigerant entering the evaporator and is transported to the compressor for recompression and recycling of the refrigerant through the system.

In such air conditioning systems it is necessary to prevent liquid refrigerant from being introduced into the compressor in order to protect the compressor from "liquid slugging back" effects which significantly detract from the integrity of the compressor. Efforts to assure that essentially only vaporous refrigerant, preferably saturated vaporous refrigerant, is introduced in the compressor the evaporators are usually appropriately sized so that the evaporator coil arrangement therein providing for the direct expansion of the liquid refrigerant entering the evaporator is provided with a dry coil region, i.e., free of liquid refrigerant, and corresponding to about ten percent of the evaporator coil volume for assuring that all or essentially all of the liquid refrigerant is evaporated in the evaporator. This dry coil region in the evaporator does not provide for any meaningful cooling of the heat exchange medium passing through the evaporator and thus adversely affects the overall system effectiveness of the air conditioning system.

Additionally, some air conditioning systems have been fitted with suction line heat exchangers which are utilized to exchange heat between the hot condensed liquid refrigerant or another liquid such as water and the vaporous refrigerant discharged from the evaporator for assuring that any liquid refrigerant contained in the suction lines is converted to vapor. The use of such a suction line heat exchanger also causes the vaporous refrigerant in the suction line to be superheated but such superheating of the gaseous refrigerant directly affects the temperature of the vaporous refrigerant discharged from the compressor and requires that the compressor provide additional work for compressing the vaporous refrigerant to the required pressure necessary for effecting the condensation thereof in the condenser. In as much as the dry coil region of the evaporator normally assures that little if any liquid refrigerant enters the suction line, the evaporation of any liquid present in the suction line by using suction line heat exchangers will provide compressor protection.

The type of refrigerant employed in conventional air conditioning systems such as generally described above is of considerable importance in determining the cooling efficiency of the system. A commonly used refrigerant of the many available refrigerants is refrigerant-12 formed of dichlorofluoromethane ($CC1_2F_2$) and which is a medium pressure/medium capacity refrigerant. Refrigerant-22 formed of monochlorodifluormethane ($CHC1F_2$) provides an alternative to refrigerant-12 but is a high pressure/high capacity refrigerant which requires some system modifications for handling such a refrigerant. However, the use of refrigerant-12 and refrigerant-22 as well as other refrigerants which contain chlorine have been found to be environmentally unacceptable since the chlorine component is considered to be a principal involved in the ongoing destruction of the protective ozone layer encompassing the earth. While refrigerant-22 reportedly causes only about five percent as much damage to the ozone layer as a similar volume of refrigerant-12 discharged into the atmosphere at the surface of the earth, the utilization of either of these refrigerants in the manufacture of new air conditioning systems as well as in repairing or modification of existing air systems is presently discouraged and is expected to be banned altogether by legislation.

Recently, developments in refrigerants which are expected to be environmentally acceptable are chlorine-free and include the refrigerant-134a formed of tetrafluoroethane ($CF_3CH_2F$). It is anticipated that the use of such a chlorine-free refrigerant will be soon required in the manufacture and the repair of air conditioning systems such as used in the transportation industry, refrigerators, freezers, building cooling applications, and in heat pump assemblies.

However, it has been found that the utilization of refrigerants other than refrigerant-12 and refrigerant-22 in existing air conditioning systems result in considerable reduction in system efficiency. For example, in a conventional automotive air conditioning system the use of refrigerant-134a in place of refrigerant-12 results in a decrease in system efficiency of about six percent.

SUMMARY OF THE INVENTION

It is an object of the present invention to provide an improved air conditioning system having a system efficiency considerably higher than attainable with previously known air conditioning systems when using the same refrigerant or when using a less efficient refrigerant such as refrigerant-134a in place of presently used refrigerant-12 and refrigerant-22.

Another object of the present invention is to provide an air conditioning system with a liquid over-feeding operation rather than previously utilized direct expansion operations for increasing the cooling capacity of the air conditioning system by eliminating the need for dry coil regions in the evaporator.

Another object of the present invention is to pass hot liquid refrigerant from the condenser in a heat exchange relationship with a relatively cool mixture of liquid and vaporous refrigerant discharged from the evaporator to substantially sub-cool the liquid refrigerant from the condenser so that little or no vaporization of the refrigerant occurs across the expansion device and to provide the evaporator with a relatively cool stream of liquid refrigerant in a liquid over-feeding arrangement wherein a substantial portion of the liquid refrigerant is not evaporated in the evaporator and is subsequently used to effect the subcooling of the hot liquid refrigerant discharge from the condenser.

A further object of the present invention is to provide an accumulator-heat exchanger assembly wherein the mixture of liquid and vaporous refrigerant discharged from the evaporator is used in heat exchange relationship with hot refrigerant from the condenser for subcooling the hot refrigerant by at least about 20 F while evaporating the liquid refrigerant in the mixture and wherein the vaporous refrigerant from the mixture is conveyed as saturated vapor to the compressor for recycling.

A still further object of the present invention is to provide an air conditioning system when compared to air conditioning systems using direct expansion operation, provides for a substantial reduction in the compressor discharge pressure, cycling losses, and power consumption, provides an increase in the suction pressure, provides an improvement in the compressor volumetric efficiency, and provides a relatively fast cooling response time during start-up.

Generally, the air conditioning system of the present invention comprises refrigerant compressing means, refrigerant condensing means, expansion means, and refrigerant evaporating means operatively interconnected by conduit means. The improvement in the air conditioning system as provided by the present invention comprises heat exchange means that are operatively associated with the Conduit means and are adapted to receive relatively hot liquid refrigerant from the condensing means and a relatively cool mixture of liquid and vaporous refrigerant from the evaporator means in a heat exchange relationship therebetween for substantially sub-cooling the liquid refrigerant from the condensing means and converting liquid refrigerant in the mixture to vaporous refrigerant. The heat exchange means are adapted to retain liquid refrigerant from the mixture in the heat exchange relationship with the liquid refrigerant from the condensing means for effecting the sub-cooling of the latter while effecting the conversion of liquid refrigerant from the mixture to vaporous refrigerant. The heat exchange means are also adapted to convey therefrom through the conduit means to the compressing means the vaporous refrigerant from the mixture and with vaporous refrigerant resulting from the aforementioned conversion of liquid refrigerant in the heat exchange means.

The sub-cooling of the liquid refrigerant discharged from the condensing means by being in heat exchange relationship with the liquid from the mixture is sufficient to provide substantially no evaporation thereof during passage through the expansion means.

The heat exchange relationship established between the relatively cool mixture and the hot liquid refrigerant from the condensing means is sufficient to sub-cool the liquid refrigerant from the condensing means by a temperature of at least about 20° F.

The heat exchange means of the present invention comprises vessel means having a cavity therein. One segment of the conduit means that conveys liquid refrigerant from the condensing means is contained in the cavity in the vessel means. A second segment of the conduit means is used for conveying the mixture of liquid and vaporous refrigerant from the evaporating means to the compressing means and comprises first and second conduit sections. The first conduit section is in open communication with the cavity in the vessel means for conveying the mixture of liquid and vaporous refrigerant from the evaporating means into the cavity. The second conduit section being is open communication with the cavity for conveying substantially saturated vaporous refrigerant therefrom to the compressing means.

The operation of the air conditioning system of the present invention comprises the steps of: passing liquid refrigerant discharged from the condensing means in a heat exchange relationship with a mixture of liquid and vaporous refrigerant discharged from the evaporating means for vaporizing liquid refrigerant in the mixture and sufficiently sub-cooling the liquid refrigerant from the condensing means to provide substantially no evaporation of the sub-cooled liquid in the refrigerant expansion means and for providing the mixture of liquid and vaporous refrigerant from the evaporating means; and, conveying vaporous refrigerant from the mixture and from the vaporization of the liquid refrigerant in the mixture to the compressing means.

Other and further objects of the present invention will become obvious upon an understanding of the illustrative embodiment about to be described or will be indicated in the appended claims, and various advantages not referred to herein will occur to one skilled in the art upon employment of the invention in practice.

DESCRIPTION OF THE DRAWING

The Figure is a schematic illustration of an air conditioning system of the present invention wherein an accumulator-heat exchanger assembly is utilized to provide the system with a liquid over-feeding operation.

DETAILED DESCRIPTION OF THE INVENTION

As generally described above, the present invention is directed to a refrigeration air conditioning system employing in a conventional arrangement, a refrigerant compressor, a condenser, an expansion device, and an evaporator which are operatively coupled together by a conduit or piping arrangement through which a suitable refrigerant is circulated through the system components in liquid and vaporous form to provide the desired air conditioning effect. The air conditioning system of the present invention is improved over the previous air conditioning systems by utilizing an accumulator-heat exchanger assembly that is operatively coupled in the system conduit or piping for providing the air conditioning system with a liquid over-feeding operation rather than a direct expansion operation as utilized in previous air conditioning systems. In direct expansion operations about 10 percent of coils in the evaporator are purposefully utilized to form a dry coil region for protecting the compressor. The liquid over-feeding operation of the present invention, on the other hand, enables 100 percent of the evaporator coils to be used for cooling purposes so as to represent an increase in cooling capacity of at least about 10 percent over the previous air conditioning systems using direct expansion operations.

The air conditioning system of the present invention when utilizing the same refrigerant as used in direct expansion-type air conditioning systems provides for a reduction in the compressor discharge pressure while raising the suction pressure, improves the compressor volumetric efficiency, reduces cycling losses and power consumption, and provides for a relatively rapid cooling response during system start-up.

As described above, the refrigerants capable of being used in the present invention include essentially all the commercially available refrigerants, including refrigerants such as refrigerant-12, refrigerant-22, or refrigerant-134a, azeotropic refrigerants such as refrigerant-500, and non-azeotropic refrigerant mixtures such as mixtures of refrigerant-32 and refrigerant-22 with refrigerant-134a and refrigerant-152a, respectively. The particular refrigerant utilized in the present invention is not deemed to be critical and yet the present invention is expected to perform with greater system efficiency than a previously known air conditioning system utilizing the same or even a more efficient refrigerant.

With reference to the Figure, the air conditioning system 10 of the present invention is shown comprising a compressor 12 which is utilized to compress vaporous refrigerant to a pressure adequate to effect the condensation of the vaporous refrigerant to liquid form when passed through coils 14 of the condenser 16 via conduit 18. The particular pressure and temperature of the compressor discharge stream is dependent upon the type of refrigerant being used and the ambient operating conditions. The compressor discharge pressures and temperatures employed for these refrigerants are well documented in the literature. Also, the compressor 12 may be of any suitable commercially type such as a rotary or piston type compressor.

The condenser 16 is defined by a housing 20 with cooling fins 22 appropriately positioned about the coils 14 for facilitating the cooling thereof when a heat exchange medium such as water or air is passed through the housing 20 in heat exchange relationship with the condenser coils 14 for extracting heat from the vaporous refrigerant for cooling and condensing the refrigerant to liquid form while maintaining the refrigerant at a substantially uniform pressure. In an air-type cooling operation a fan 24 may be utilized to move a stream of air through the condenser coils 14 for effecting the desired removal of heat from the condensing refrigerant. In the present system, the use of a receiver for separating vapor and liquid discharged from the condenser is not required.

A conduit 26 is utilized to connect the condenser 16 to an expansion assembly or device 28 which is provided with any suitable mechanism for dropping the pressure of the condensed liquid refrigerant in conduit 26 to a pressure at which vaporization of the refrigerant may be achieved for effecting the absorption of heat from the surrounding environment. A suitable expansion mechanism may provided by a fixed orifice such as shown generally at 30. The expanded refrigerant is then introduced through the conduit 32 into the evaporator 34 where a substantial portion of the liquid refrigerant is evaporated while passing through coils 36 of conduit 32 to absorb heat from a heat exchange medium such as water or air passing through the evaporator housing 38. A fan 39 is shown for moving a stream of air in heat exchange relationship with the refrigerant in coils 36 with this air stream being cooled to a temperature in the range of about 35° to 45° F. for providing the desired cooling or air conditioning effect at a point of use (not shown). The evaporator 34, in turn, is coupled to the compressor 12 through suction line or conduit 40 for returning vaporous refrigerant to the compressor for completing the cycle and recompressing vapor for subsequent recycling.

In accordance with the present invention, the hot condensed liquid from the condenser 16 at a time prior to entering the expansion device 28 is passed in heat exchange relationship with a mixture of vaporous and liquid refrigerant at a temperature of about 35 to 45° F. that has been discharged from the evaporator 34 for super sub-cooling the liquid refrigerant discharged from the condenser 16 while vaporizing liquid refrigerant in the mixture discharged from the evaporator 34. This heat exchange relationship between the hot condensed liquid refrigerant and the relatively cool liquid-vapor mixture discharged from the evaporator 34 is achieved by employing an accumulator-heat exchanger assembly 42. This accumulator-heat exchanger assembly 42 is provided by a vessel or housing 44 which is preferably of an elongated cylindrical configuration and is vertically oriented in the air conditioning system. The housing 44 is formed of side walls 46, a base wall 48, and a top wall 50 for defining an enclosed cavity 52. The size of the cavity within the housing is adequate for storing or retaining sufficient liquid refrigerant from the mixture of vaporous and liquid refrigerant discharged from the evaporator 34 for super subcooling the hot condensed liquid refrigerant discharged from the condenser 16 to a desired temperature. For example, in an automotive air conditioning system a housing 44 of about 8 to 12 inches in length and a diameter of about 4 to 6 inches is sufficiently large to define a cavity 52 with sufficient liquid capacity for effectively super sub-cooling the hot condensed refrigerant to provide the desired liquid over-feeding operation of the present invention and yet is of a size sufficiently small so as to be readily positioned under the hood of present day automobiles.

The accumulator-heat exchanger 42 encompasses a segment 54 of conduit 26 at a location between the condenser 16 and the expansion device 28. This segment 54 of conduit 26 is substantially in the form coils 56 which are contained within the cavity 52 of housing 44. As shown, the hot condensed liquid refrigerant from the condenser 16 passes through the coils 56 in the housing 44 in a heat exchange relationship with a pool 58 of relatively cool liquid refrigerant in a lower region of the cavity 52 and the mixture of vaporous and liquid discharged from the evaporator into an upper region of cavity 52 for effecting the sub-cooling of the hot liquid refrigerant before it is passed into the expansion device 28. The sub-cooling of the liquid refrigerant discharged from the condenser is sufficient to cool the relatively hot liquid refrigerant from a condenser discharge temperature in the range of about 110° to 120° F., usually about 20° to 30° F. higher than ambient air temperature, to a temperature in the range of about 70 to 90° F. Such a considerable drop in temperature is the result of super sub-cooling since the extent of cooling is significantly greater than any sub-cooling of the liquid refrigerant that may occur in the conduit system, the expansion device, or in a suction line heat exchanger as previously utilized. Any sub-cooling of the hot condensed liquid refrigerant achieved in previous air conditioning systems will sub-cool the hot liquid refrigerant only about 10° to 12° F., which is insufficient to provide the liquid overfeeding operation of the present invention.

The effect of such super sub-cooling of the hot liquid refrigerant discharged from the condenser 16 provides for no or essentially no vaporization of the super sub-cooled liquid refrigerant at normal ambient operating temperatures and only about 5 to 10 percent vaporization of the liquid refrigerant during abnormally high ambient operating temperatures as it passes through the expansion device 28. This non-existent or, at most, relatively small level of vaporization of the liquid passing through the expansion device 28 assures that the evaporator 34 receives the expanded refrigerant in at least essentially liquid for partial evaporation thereof within the evaporator 34. This arrangement increases the cooling efficiency of the present system over previously known systems which experience substantial cooling losses due to the evaporation of a considerable percentage, usually about 20 to 25 percent, of the liquid refrigerant at the expansion device 28. The refrigerant liquid discharged from the expansion device 28 passes through the evaporator coils 36 with a major portion of the liquid refrigerant evaporating therein to provide the desired cooling effect over 100 percent of the coil area. During this evaporation of the refrigerant in the evaporator 34, about 85 to 90 percent, by weight, of the liquid refrigerant is evaporated so as to form the mixture of the relatively cool vaporous and liquid refrigerant which is discharged through the evaporator 34 into the suction conduit 40. This mixture of vaporous and liquid refrigerant is a temperature in the range of about 35° to 45° F. and is discharged into the cavity 52 of the accumulator-heat exchanger 42 through an open-ended section 60 of conduit 40. This conduit section 60 preferably extends into the cavity 52 of the housing 44 through the top wall 50 so as to position the open end 62 of the conduit segment 60 in the uppermost region of the cavity 52 at a location overlying the pool 58 of liquid refrigerant. The open end 62 of the conduit segment 60 is preferably fitted with a spray nozzle 64 so as to assure the distribution of the liquid and vaporous refrigerant in the mixture over the coils 56 for supplementing the cooling of the hot liquid refrigerant contained therein by the liquid refrigerant contained in the pool 58. During this contacting some of the liquid in the mixture undergoes evaporation with the excess or non-evaporated liquid from the mixture forming the pool 58. Also, during the subcooling of the hot liquid refrigerant contained in the section of the coils 56 emersed in the pool 58, liquid refrigerant in the pool undergoes evaporation and rises into the upper region of the cavity 52.

A section 66 of suction conduit 40 receives vaporous refrigerant contained within the upper region of the cavity 52 of the accumulator-heat exchanger 42 through the open end 68 of the conduit section 66 positioned at a location overlying the pool of liquid refrigerant 58. This vaporous refrigerant is conveyed to the compressor 12 through the conduit section 66 and the remainder of conduit 40 disposed between the accumulator-heat exchanger 42 and the compressor 12 for the recompression and recycling of the refrigerant through the system. The open end 68 of conduit section 66 is positioned within the cavity 52 at such a location that the liquid-vapor refrigerant mixture introduced into the cavity 52 through the open end 62 of the conduit section 60 will not contact the opening 68 of the conduit section 66 to assure that liquid refrigerant from the mixture will not be entrained with the vaporous refrigerant drawn into the conduit section 66. Preferably, the open end 68 of the conduit section 66 is positioned at a location spaced from and higher in the vessel cavity 52 than the discharge end 62 of the conduit section 60. As shown in the Figure, the conduit section 66 extends from the open end 68 thereof through the pool 58 of the liquid refrigerant before exiting from the vessel 44 so as to assure that any super heated vaporous refrigerant within the conduit section 66 will be cooled by the pool of liquid refrigerant so that only saturated vapor and not superheated vapor will be conveyed from the accumulator-heat exchanger 42 to the compressor 12.

If desired, a suitable desiccant (not shown) such as XH-7 or XH-9 may be mounted in the cavity 52 adjacent the upper wall 50 of the vessel 44 for removing moisture from the system. Also, if desired a dryer (not shown) may be appropriately placed in the conduit system for moisture removal.

An air conditioning system utilizing the liquid over-feeding operation of the present invention while using the refrigerant-22 provides a system efficiency of about 15 percent greater than a conventional air conditioning system employing direct expansion operation using the refrigerant-12. Additionally, the liquid over-feeding arrangement of the present invention is particularly suitable for use of non-azeotropic refrigerants which allow for tailoring the properties of the refrigerants for use in the air conditioning system. The use of non-azeotropic refrigerants in the system of the present invention is expected to be more advantageous than the use of such refrigerants in previously known systems due to high liquid sub-cooling.

In order to more clearly describe features of the present invention, the following Table sets forth a comparison of the operating parameters of a liquid over-feeding air conditioning system of the present invention with those of a direct expansion air conditioning system with both systems employing similarly sized compressors, condensers, expansion devices and evaporators and with both systems operating at similar ambient temperatures using refrigerant-22 as the working fluid.

TABLE

| OPERATING CONDITIONS | OVER-FEEDING AIR CONDITIONING SYSTEM | DIRECT EXPANSION AIR CONDITIONING SYSTEM |
|---|---|---|
| Discharge Pressure, psia | 200.2 | 224.7 |
| Suction Pressure, psia | 81.3 | 76.7 |
| Discharge Temperature, °F. | 166.7 | 177.7 |
| Suction Temperature, °F. | 40.0 | 37.4 |
| Refrigerant Pressure before Expansion, psia | 184.7 (85° F. sat.) | 224.7 (105° F. sat) |
| Refrigerant | 52.0 | 81.7 |

TABLE-continued

| OPERATING CONDITIONS | OVER-FEEDING AIR CONDITIONING SYSTEM | DIRECT EXPANSION AIR CONDITIONING SYSTEM |
|---|---|---|
| Temperature before Expansion, °F. Refrigerant | 51.5 | 56.1 |
| Temperature after Expansion, °F. Refrigerant | 40.2 | 37.8 |
| Temperature at Evaporator exit, °F. Refrigerant Pressure after Expansion, psia | 81 | 80 |
| Enthalpy Difference across Compressor (compressor efficiency not considered), Btu/lb | 18.2 | 19.6 |
| Saving on Compressor Power Consumption, (%) | 7.14 | |
| Reduction in Discharge-Suction Pressure Differential, psi | 29.1 | |
| Time Required to Re-achieve Steady State Condition after Operation Shut off for Five Minutes, Min | 1.5 | 3.5 |

As shown in this Table, even at room condensing and evaporating conditions, the liquid over-feeding system of the present invention reduces the compressor discharge pressure by a substantial 24.5 psi while increasing the suction pressure by 4.6 psi, provides a reduction of high- and low-side pressure differential by 29.1 percent, provides a reduction in the power consumption per unit cooling by a substantial 7.14 percent, and provides a reduction of cycling loss by more than about one-half. While the Table utilizes the refrigerant-22 for comparison purposes, it is expected that similar performances and operational differences will be obtained when utilizing refrigerant-12, refrigerant-134a, azeotropic or non-azeotropic refrigerants, and other suitable refrigerants as presently known in the industry.

It will be seen that the air conditioning system of the present invention by providing for a liquid over-feeding operation exhibits significant improvements in operational efficiency over known air conditioning systems. Thus, the expected requirement for the use of less efficient but environmentally safer refrigerants will not have the expected deleterious impact upon the air conditioning industry.

What is claimed is:

1. An air conditioning system employing a vaporizable liquid refrigerant and comprising in combination, compressing means adapted to compress vaporous refrigerant, condensing means coupled to the compressing means by first conduit means for receiving the compressed vaporous refrigerant and condensing the vaporous refrigerant to liquid refrigerant, second conduit means for conveying the liquid refrigerant from the condensing means, heat exchange means operatively associated with a section of the second conduit means and comprising vertically oriented vessel means having a cavity therein for containing in a lower region thereof a pool of liquid refrigerant with one segment of the second conduit means being contained within the cavity with a substantial portion thereof being located in the lower region of the cavity in a heat exchange relationship with the liquid refrigerant in said pool, expansion means operatively associated with said second conduit means for receiving liquid refrigerant from the heat exchange means, refrigerant evaporating means coupled to the second conduit means for receiving liquid refrigerant from the condensing means through said expansion means, and third conduit means comprising first and second conduit sections with said first conduit section adapted to convey a mixture of liquid and vaporous refrigerant from the evaporating means into the cavity of said vessel means to form said pool of liquid refrigerant for primarily subcooling the liquid refrigerant in said one segment of the second conduit means to a temperature of at least about 20° F. lower than that of the liquid refrigerant conveying from the condensing means into the heat exchange means and for vaporizing liquid refrigerant in said mixture and liquid refrigerant in said pool and with said second conduct section adapted to receive and convey substantially saturated vaporous refrigerant from said heat exchange means to said compressing means.

2. An air conditioning system employing a vaporizable liquid refrigerant as claimed in claim 1, wherein said first conduit section of the third conduit means extends into said cavity and has an open end thereof in communication with an upper region of said cavity at a location overlying the pool of liquid refrigerant, and wherein said second conduit section of the third conduit means extends into said cavity and has an open end thereof in communication with the upper region of the cavity at a location overlying the pool of liquid refrigerant and spaced from the open end of said first conduit section of the third conduit means.

3. An air conditioning system employing a vaporizable liquid refrigerant as claimed in claim 2, wherein nozzle means are disposed at the open end of said first conduit section for distributing said mixture of liquid and vaporous refrigerant through a substantial portion of the upper region of the cavity.

4. An air conditioning system employing a vaporizable liquid refrigerant as claimed in claim 2, wherein a portion of said second conduit section of the third conduit means is disposed in the lower region of the cavity in the pool of liquid refrigerant for providing a heat exchange relationship between liquid refrigerant in the pool of liquid refrigerant and vaporous refrigerant within said portion of said second conduit section of the third conduit means to sufficiently cool the vaporous refrigerant therein to effect substantial saturation thereof.

5. An air conditioning system employing a vaporizable liquid refrigerant as claimed in claim 2, wherein a substantial portion of said segment of the second conduit mans contained within the cavity is of a coiled configuration.

6. A method for operating an air conditioning system having refrigerant compressing means, refrigerant condensing means, refrigerant expansion means, and refrigerant evaporating means operatively interconnected by conduit means, comprising the step of passing liquid refrigerant discharged from the condensing means in a heat exchange relationship with a mixture of liquid and vaporous refrigerant discharged from the evaporating means and a pool of liquid refrigerant provided by liquid refrigerant from said mixture for vaporizing liquid refrigerant in said mixture and in said pool for sufficiently sub-cooling the liquid refrigerant discharged from the condensing means to provide substantially no evaporation of the sub-cooled liquid across the refrigerant expansion means and thereby over feeding of the evaporating means with liquid refrigerant for effecting contact of all cooling regions therein with liquid refrigerant and for providing said mixture of liquid and vaporous refrigerant discharged from the evaporating means, and conveying vaporous refrigerant from said mixture and from the vaporization of the liquid refrigerant contained in said mixture and in said pool to the refrigerant compressing means.

7. A method for operating an air conditioning system as claimed in claim 6, wherein the sub-cooling of liquid refrigerant discharged from the condensing means is provided primarily by being in a heat exchange relationship with the liquid refrigerant in the pool of liquid refrigerant, and wherein the sub-cooling of the liquid refrigerant is sufficient to provide the sub-cooled liquid refrigerant with a temperature of at least about 20° F. lower than the temperature of the liquid refrigerant discharged from the condensing means.

8. A method for operating an air conditioning system as claimed in claim 7, wherein the temperature of the liquid refrigerant discharged from the condensing means is in the range of about 20° to 30° F. above ambient air temperature, and wherein the temperature of the sub-cooled liquid refrigerant of at least 20° F. lower than the temperature of the liquid refrigerant discharged from the condensing means is a temperature in the range of about 20° F. to 50° F.

9. A method for operating an air conditioning system as claimed in claim 7, including the additional step of passing the vaporous refrigerant being conveyed to the compressing means in heat exchange relationship with the pool of liquid refrigerant for substantially saturating the vaporous refrigerant conveyed to the compressing means.

10. A method for operating an air conditioning system as claimed in claim 6, wherein the over feeding of the evaporating means with liquid refrigerant provides a sufficient excess of liquid refrigerant through the evaporating means to provide the mixture with a sufficient volume of liquid refrigerant to form the pool of liquid refrigerant and primarily effect said sub-cooling of the liquid refrigerant discharged from the condensing means.

11. A method for operating an air conditioning system as claimed in claim 10, wherein at least about 10 percent of said mixture discharged from the evaporating means is liquid refrigerant.

12. A method for operating an air conditioning system as claimed in claim 6 including the additional step of maintaining the pool of liquid refrigerant in said heat exchange relationship with the liquid refrigerant from the condensing means during the operation of the air conditioning system.

13. A method for operating an air conditioning system as claimed in claim 6, including the additional step of passing the vaporous refrigerant from the mixture and from the vaporization of the liquid refrigerant from the mixture and from the pool of liquid refrigerant in a heat exchange relationship with the pool of liquid refrigerant during the conveyance of the vaporous refrigerant to the refrigerant compressing means for effecting the substantial saturation thereof.

* * * * *